US005141171A

United States Patent [19]

Yang

[11] Patent Number: 5,141,171

[45] Date of Patent: Aug. 25, 1992

[54] STRUCTURE OF DISPENSING HOPPER FOR PAPER ROLL HOLDER

[75] Inventor: George C. Yang, Taipei, Taiwan

[73] Assignee: U-Maek Industry Co., Ltd., Taipei, Taiwan

[21] Appl. No.: 721,419

[22] Filed: Jun. 26, 1991

[51] Int. Cl.[5] ..... B65H 16/00; A47K 10/22

[52] U.S. Cl. ..... 242/55.54; 242/132; 242/137.1; 206/409; 206/233; 225/82; 225/106

[58] Field of Search ..... 242/55.54, 55.42, 55.53, 242/132, 137, 137.1, 146; 225/106, 82; 206/233, 494, 407, 409, 390

[56] References Cited

U.S. PATENT DOCUMENTS

| | | | |
|---|---|---|---|
| 1,344,274 | 6/1920 | Hubbard | 242/137.1 |
| 3,843,017 | 10/1974 | Harrison | 225/106 |
| 3,868,052 | 2/1975 | Rockefeller | 225/106 |
| 4,171,047 | 10/1979 | Doyle et al. | 206/409 |
| 4,219,129 | 8/1980 | Sedgwick | 206/409 |
| 4,244,493 | 1/1981 | Harrison | 225/106 |
| 4,524,895 | 6/1985 | Lunden | 225/106 |
| 4,760,970 | 8/1988 | Larsson et al. | 242/55.54 |

FOREIGN PATENT DOCUMENTS 0107487 5/1984 European Pat. Off. ..... 242/55.54

*Primary Examiner*—Daniel P. Stodola
*Assistant Examiner*—John Q. Nguyen
*Attorney, Agent, or Firm*—Fleit, Jacobson, Cohn, Price, Holman & Stern

[57] ABSTRACT

A dispensing hopper fastened in a paper roll holder at the bottom for dispensing a paper roll, the improvement comprising a hopper body having a rotary seat revolvably secured thereto at the bottom to hold an oscillating member permitting it to oscillate on an axle disposed in radial direction through said rotary seat, wherein said oscillating member has an opening vertically through the center thereof which is consisted of two opposed tapered holes with a small hole connected therebetween, and two V-shaped retaining notches on the top edge thereof at two opposite locations at right angles to said axle. The leading end of the crepe paper of the paper roll is inserted through the tapered hole on the hopper body and lead out of the opening on the oscillating member. Pulling the crepe paper from the paper roll causes the oscillating member to oscillate to a matched angle permitting the crepe paper to be firmly retained in either V-shaped retaining notch for easy splitting.

2 Claims, 4 Drawing Sheets

STRUCTURE OF DISPENSING HOPPER FOR PAPER ROLL HOLDER

BACKGROUND OF THE INVENTION

The present invention relates to a paper roll holder dispensing hopper structure and relates more particularly to an improved structure of dispensing hopper for a paper roll holder which has V-shaped retaining notches which will be automatically adjusted to a matched angle to firmly retain the crepe paper in position for splitting.

FIG. 1 illustrates a dispensing hopper for a paper roll holder according to the prior art. This dispensing hopper is simply a funnel-shaped plastic member having a tapered hole at the center. Because the tapered hole on the dispensing hopper is fixed made in size according to the thickness of the crepe paper of the paper roll to be used. The dispensing hopper is not suitable for dispensing paper roll of all specifications. Further, while splitting the crepe paper, the crepe paper may be caused to displace and couldn't be pulled apart easily.

SUMMARY OF THE INVENTION

The present invention has been accomplished to eliminate the aforesaid problems. According to the present invention, there is provided a dispensing hopper fastened in a paper roll holder for dispensing the crepe paper of the paper roll placed therein, which has V-shaped retaining notches which can be automatically moved to a suitable angle to firmly retain the crepe paper in position for easily splitting when the crepe paper is pulled out of the dispensing hopper.

DETAILED DESCRIPTION OF THE PREFERRED EMBODIMENT

Figure 1:
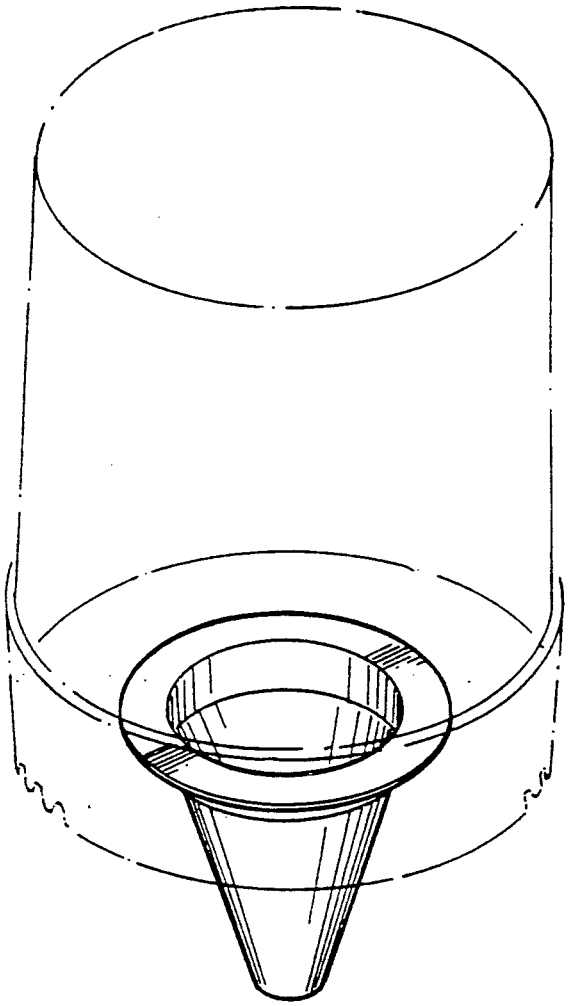
FIG. 1 (PRIOR ART)
FIG. 1 is a perspective view of a dispensing hopper for a paper roll holder according to the prior art.
Figure 2:
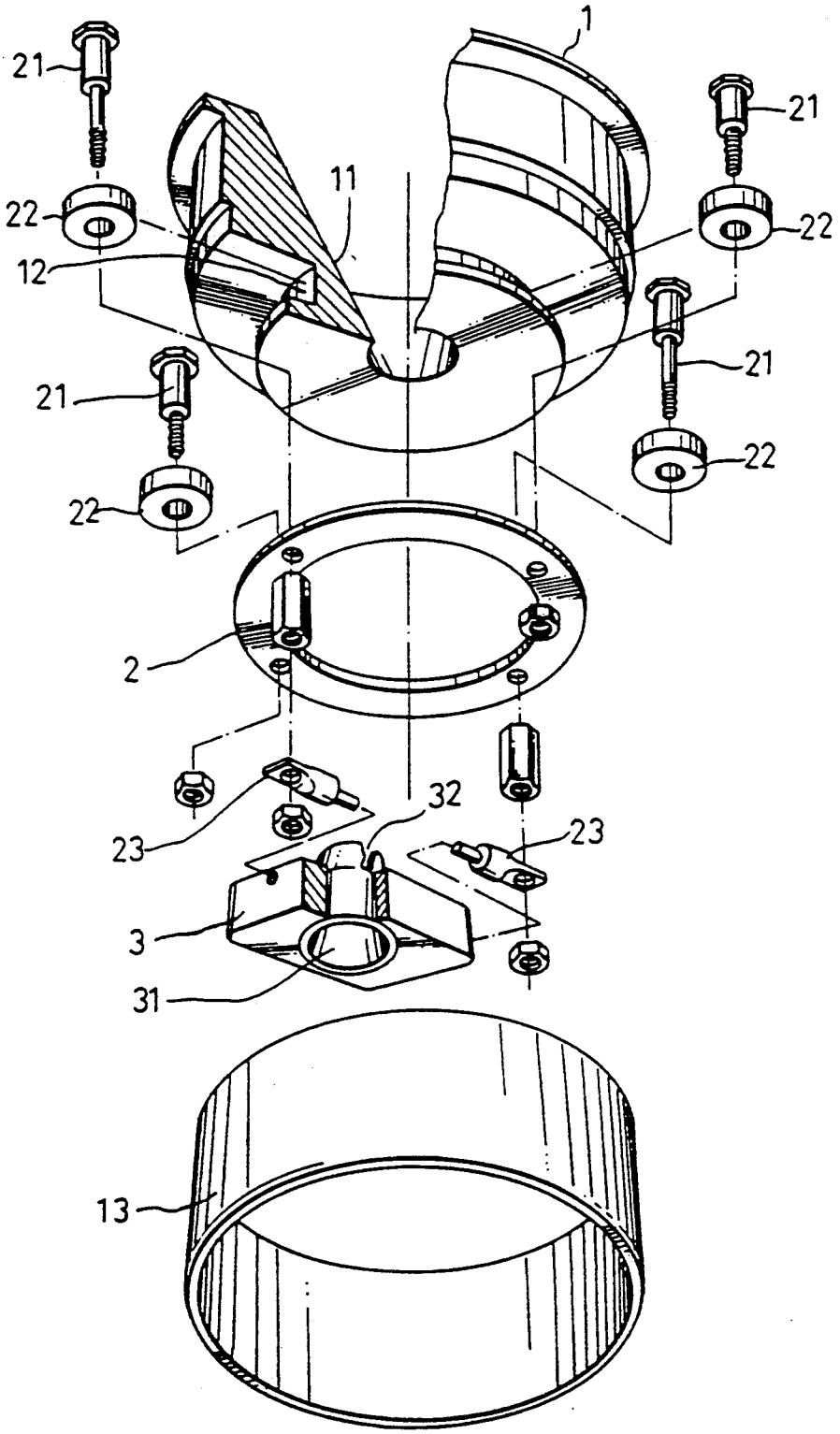
FIG. 2 is an exploded perspective view of the preferred embodiment of the dispensing hopper of the present invention.

Referring to FIG. 2, therein illustrated is the preferred embodiment of the dispensing hopper of the present invention which is generally comprised of a hopper body 1, a rotary seat 2, and an oscillating member 3. The hopper body 1 has a tapered hole 11 through the center thereof, an annular groove 12 at the bottom around the peripheral surface thereof. The rotary seat 2 is made from an annular plate having four rollers 22 equiangularly fastened thereon around the top edge thereof by screws 21, which rollers 22 are respectively engaged in the annular groove 12 on the hopper body 1 before securing to the rotary seat 2, and two opposed stub axles 23 horizontally secured to the two opposite, longer screws 21 at the bottom for holding the oscillating member 3 below the rotary body 2 permitting it to oscillate thereon. The oscillating member 3 has a double-tapered hole 31 (namely, two opposed, tapered hole connected by a small hole therebetween) longitudinally disposed through the center thereof, two V-shaped retaining notch 32 on the top edge of said double-tapered hole 31 at two opposite locations vertically disposed against the two stub axles 23 respectively. After assembly, a socket 13 is attached to the hopper body 1 to protect the rotary seat 2 and the oscillating member 3.

Figure 3:
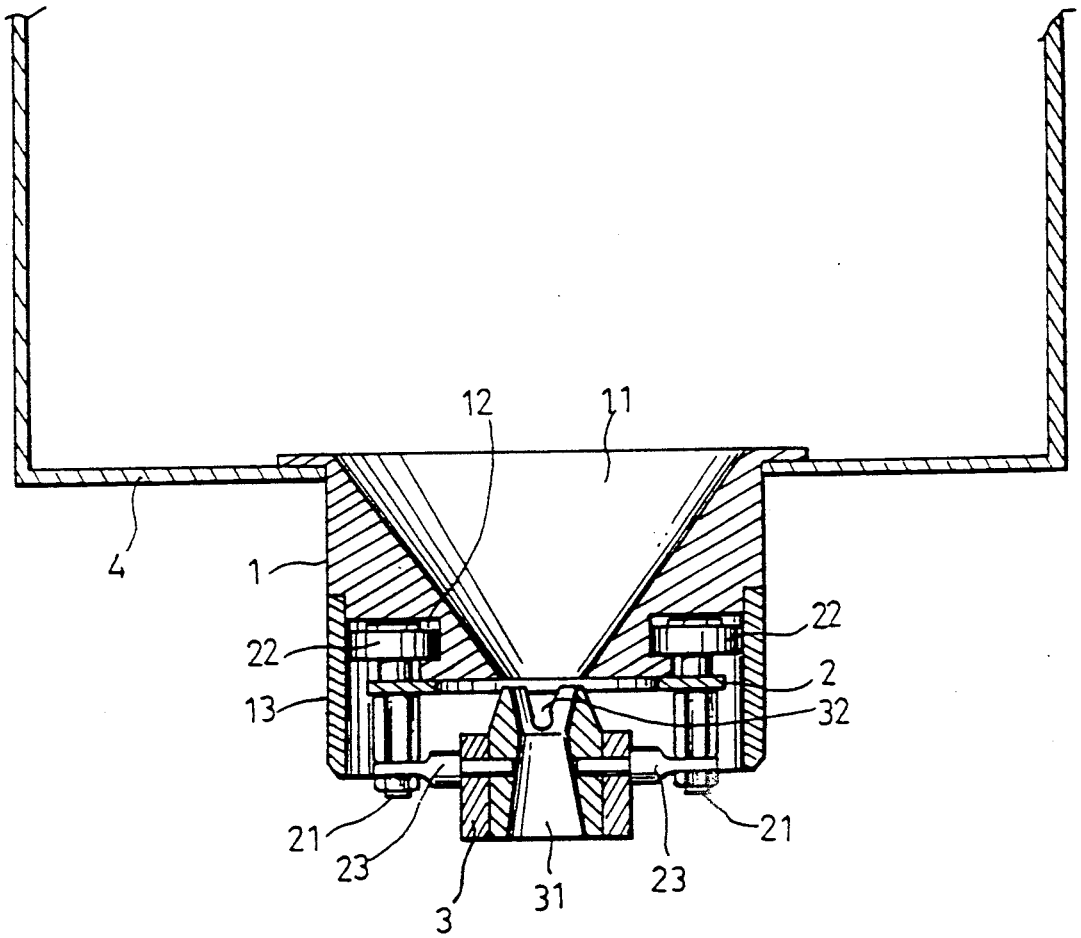
FIG. 3 is a sectional assembly view of the preferred embodiment of the dispensing hopper of the present invention.
Figure 4:
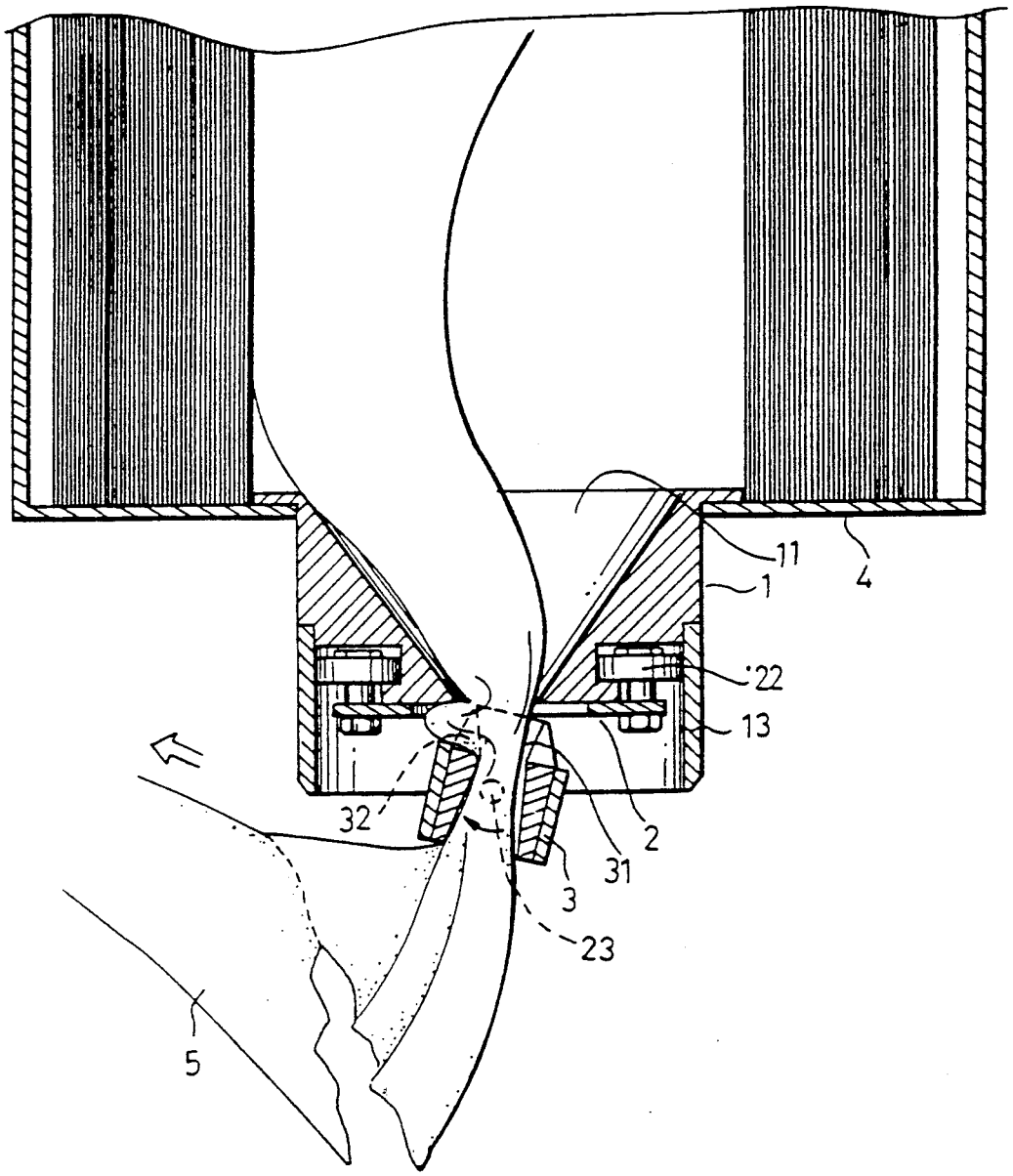
FIG. 4 illustrates the operation of the present invention.

Referring to FIGS. 3 and 4, the dispensing hopper is fastened in a paper roll holder 4 before placing a paper roll 5. After installation, the leading end of the crepe paper of the paper roll 5 is inserted through the tapered hole 11 on the hopper body 1 and lead out of the double-tapered hole 31 on the oscillating member 3. When in use, the crepe paper of the paper roll 5 is pulled vertically downwards to a desired length and then pushed sidewards to carry the oscillating member 3 to oscillate in the direction of the crepe paper permitting the crepe paper to be supported by the tapered hole 11 on the hopper body 1 and retained in the adjacent V-shaped retaining notch 32 on the oscillating member 3, and therefore, the clamping force from the V-shaped retaining notch 32 onto the crepe paper becomes stronger when the crepe paper is continuously pulled sidewards by force. The oscillating member 3 automatically move back to original position when the crepe paper is pulled apart through an indented line thereon.

As indicated, the present invention is to provide a dispensing hopper having a V-shaped retaining notch at either end which automatically adjust its angle relative to the leading part of the crepe paper to be dispensed so that the leading part of the crepe paper can be conveniently split. Further, the dispensing hopper is suitable for dispensing crepe paper in any thickness.

What is claimed is:

1. A dispensing hopper for use with a paper roll holder for dispensing a roll of paper, the hopper comprising a hopper body having an upper end defining a paper inlet and a lower end defining a paper outlet, a rotary seat revolvably secured to the hopper body under said outlet, an oscillating member pivotally mounted in said rotary seat for oscillation about a transverse axis, said oscillating member having a paper dispensing opening extending through the center thereof for communicating with said outlet, said opening comprising two oppositely tapered holes with a small hole connected therebetween.

2. The improvement of claim 1, wherein said oscillating member has two V-shaped notches in a top edge thereof at respective opposite locations at right angles to said axis.

* * * * *